United States Patent [19]

Moog et al.

[11] 4,083,578

[45] Apr. 11, 1978

[54] TOE CLIP FOR A SKI BINDING

[75] Inventors: William C. Moog, East Aurora; Colin M. Taeger, Buffalo, both of N.Y.

[73] Assignee: Moog Inc., East Aurora, N.Y.

[21] Appl. No.: 748,154

[22] Filed: Dec. 2, 1976

[51] Int. Cl.[2] ..... A63C 9/086; A63C 9/20

[52] U.S. Cl. ..... 280/618; 280/623

[58] Field of Search ..... 280/618, 620, 611, 631, 280/623, 619, 614, 617, 613, 621

[56] References Cited

U.S. PATENT DOCUMENTS

| | | | |
|---|---|---|---|
| 3,635,485 | 1/1972 | Gertsch et al. | 280/617 |
| 3,649,039 | 3/1972 | Gertsch et al. | 280/620 |
| 3,874,685 | 4/1975 | von Besser | 280/618 |
| 3,936,063 | 2/1976 | Sittmann | 280/620 |
| 4,013,304 | 3/1977 | Begey et al. | 280/618 |

FOREIGN PATENT DOCUMENTS

| | | | |
|---|---|---|---|
| 565,572 | 8/1975 | Switzerland | 280/614 |

*Primary Examiner*—David M. Mitchell
*Attorney, Agent, or Firm*—Sommer & Sommer

[57] ABSTRACT

A toe clip, adapted to hold the toe portion of a ski boot to a sole plate, is formed of a length of wire bent to have a base portion, two leg portions extending outwardly therefrom, and a loop portion adapted to be received in the toe notch of a ski boot. The ends of the wire are welded together. The toe clip may be operatively positioned in any of a plurality of transversely-extending key-shaped recesses provided in the sole-plate. The toe clip base portion is bowed in each of two perpendicular intersecting planes. One bow impedes insertion and removal of the base portion from a recess. The other bow provides a degree of friction between the base portion and the recess walls.

10 Claims, 7 Drawing Figures

Fig. 1.
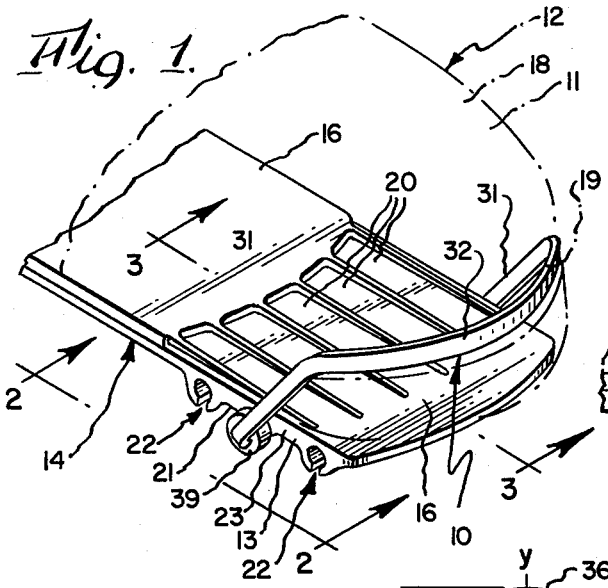
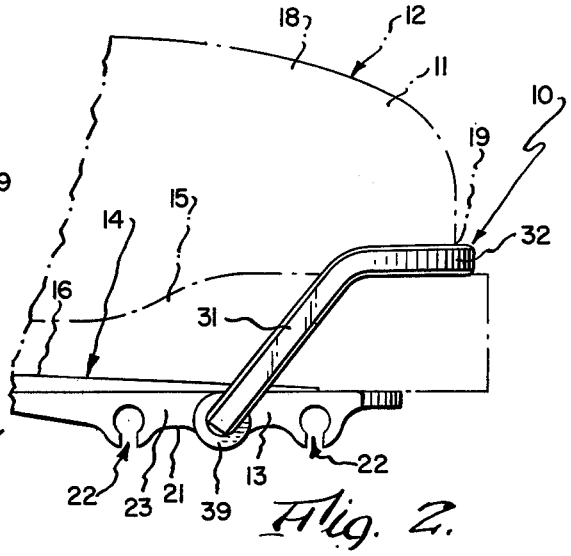
Fig. 2.
Fig. 8.
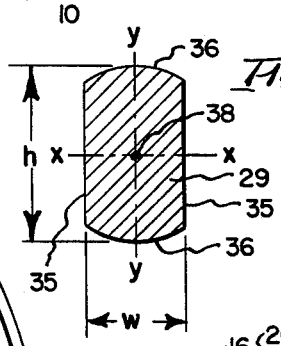
Fig. 4.
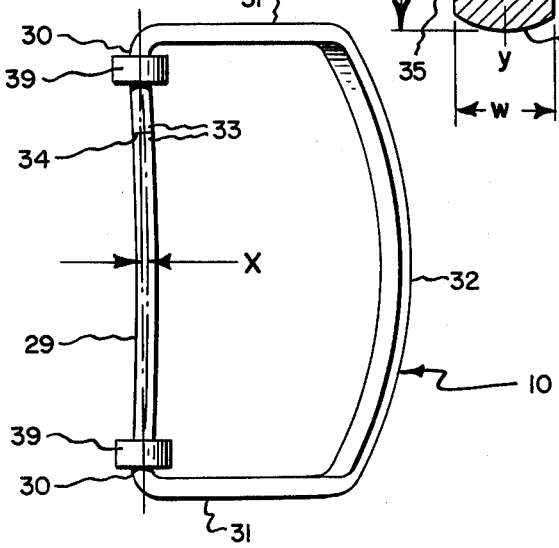
Fig. 3.
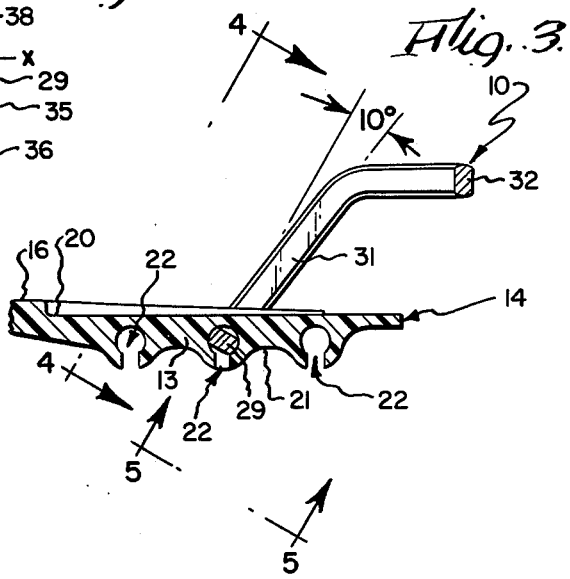
Fig. 5.
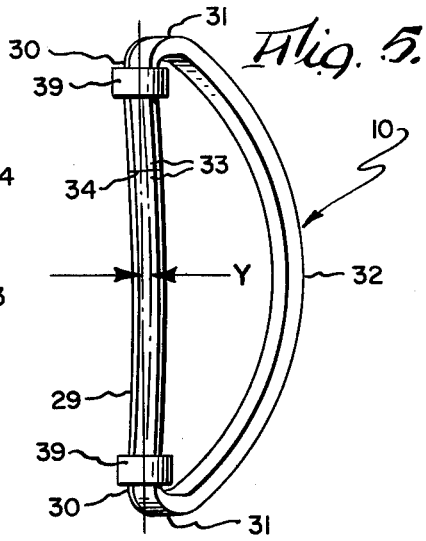
Fig. 6.
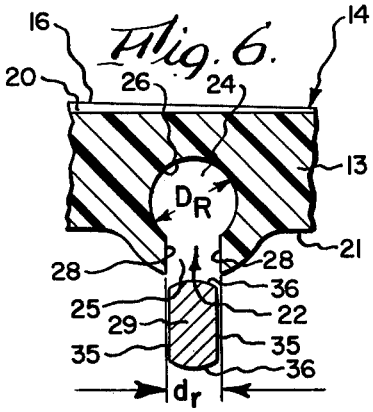
Fig. 7.
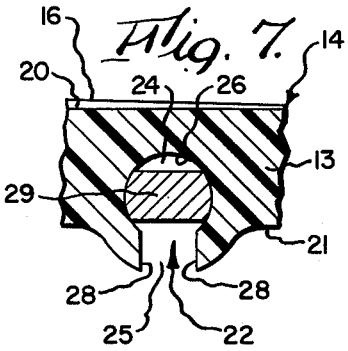

TOE CLIP FOR A SKI BINDING

BACKGROUND OF THE INVENTION

1. Field of the Invention

The present invention relates generally to the art of ski bindings, and more particularly to an improved toe clip which may be employed to releasably hold the toe portion of a ski boot to a sole-plate.

2. Description of the Prior Art

In general, a ski binding is a device for holding a boot assembly to a ski. Heretofore, two general types of such ski bindings have been developed. The first and older type provided a means for releasably mounting a skier's boot directly on the upper surface of a ski. In recent years, a plate-type binding has been developed, and one example of this is shown and described in U.S. Pat. No. 3,921,995. The plate-type binding has generally contemplated that a sole-plate by operatively arranged between the ski boot and the ski. In this regard, it is generally desired to securely connect the sole-plate to the ski boot such that the connected sole-plate and boot may separate from the ski as an assembly. Separation of this boot assembly is accommodated by the operative connection between the sole-plate and the ski.

Whereas, in the aforesaid U.S. Pat. No. 3,921,995, the toe portion of the boot was secured to the sole-plate by means of flexible cable received in the toe notch of the boot and secured to the sole plate, it has been found that the flexible nature of this cable makes it somewhat difficult for a skier to connect his boot to the sole-plate. As an alternative to this flexible toe cable, others have attempted to develop a more rigid-type of toe clip, as representatively shown in one or more of U.S. Pat. Nos. 2,117,324; 3,003,777; 3,635,485; 3,649,039; 3,727,932; 3,854,744; 3,924,868; and 3,936,063.

SUMMARY OF THE INVENTION

The present invention provides a unique toe clip which is adapted to retain the toe portion of a ski boot to a sole-plate provided with at least one uniquely configured recess extending transversely thereacross. Each recess has a substantially key-shaped cross-section and includes a cylindrical portion, and a narrowed entrance portion communicating a surface of the sole-plate with the recess cylindrical portion.

The inventive toe clip broadly comprises a continuous or endless wire-like member configured to have a base portion adapted to pass through the recess entrance portion to be removably received in the recess cylindrical portion, a leg portion extending away from the marginal ends of the base portion, and a loop portion joining the leg portions and adapted to be received in the toe notch of a ski boot; whereby the toe clip may retain the toe portion of the ski boot to the sole-plate.

If desired, the toe clip base portion may be bowed in a first plane to provide a first spring which must be displaced to enable the base portion to pass through the entrance portion, and may also be bowed in a second plane arranged perpendicular to the first plane to provide a second spring which is adapted to engage the wall surrounding the recess cylindrical portion to provide frictional resistance to rotation of the base portion relative to the sole-plate.

In the presently preferred embodiment, the toe clip is formed of a length of wire bent to have the aforesaid base, leg and loop portions, and the marginal end portions of this length of wire are arranged in the base portion and welded together. Thus, as formed, the toe clip comprises a wire-like member which is endless, or continuous, along its length. If desired, the toe clip may be case hardened after formation. Moreover, this wire-like member may, in transverse cross section, have a width less than the width of the recess entrance portion, and may have an overall height greater than the width of the recess entrance portion. In one form, the wire-like member has, in transverse cross-section, two opposite substantially parallel side surfaces, and two opposite convex or rounded end surfaces.

The toe clip may further include at least one stop member mounted on the base portion proximate a marginal end thereof and adapted to abut a side surface of the sole plate to prevent further transverse movement of the toe-clip relative to the sole-plate.

The present invention also provides an improved recess for use in a ski binding having a sole-plate to which a ski boot is adapted to be attached by means of a toe clip, and wherein this toe clip has a base portion having a cross-section defined by two opposite substantially parallel planar side surfaces and two opposite convex or rounded end portions. This improved recess extends into the sole-plate from one of the upper and lower surfaces thereof and extends continuously thereacross from side to side of the sole-plate. The improved recess has a substantially key-shaped cross-section including a relatively large diameter cylindrical portion and a relatively narrow entrance portion communicating the cylindrical portion with the appropriate upper or lower sole-plate surface; whereby the toe clip base portion may be oriented to a first position to pass through the entrance portion, and may be thereafter rotated to a second position at which the base portion will not pass through the entrance position.

Therefore, one general object of the present invention is to provide an improved toe clip which is adapted to retain the toe portion of a ski boot to a sole-plate.

Another general object is to provide an improved toe clip which, in cooperation with a plurality of transversely-extending recesses spaced longitudinally along a sole plate, enables rapid adjustment of longitudinal position of the toe clip along the sole-plate.

Another general object is to provide an improved toe clip which may accommodate different sizes of ski boots.

Another object is to provide an improved toe clip which tends to center the toe portion of a ski boot relative to a sole-plate.

Another object is to provide an improved toe clip which is adapted to resist lateral loads of a ski boot relative to a sole-plate.

These and other objects and advantages will become apparent from the foregoing and ongoing specification, the drawings, and the appended claims.

BRIEF DESCRIPTION OF THE DRAWINGS

FIG. 1 is a right front perspective view of the inventive toe clip operatively mounted on the front marginal end portion of a sole-plate, this view also showing the arcuate toe clip loop portion as being received in the toe notch of a ski boot.

FIG. 2 is a fragmentary right side elevation thereof, taken generally on line 2—2 of FIG. 1.

FIG. 3 is a fragmentary vertical sectional view thereof, taken longitudinally of the sole-plate on line 3—3, with the boot removed.

FIG. 4 is an enlarged detail view of the toe clip, taken generally on line 4—4 of FIG. 3, this view looking at the toe clip base portion along the $Y$—$Y$ plane through the base portion.

FIG. 5 is an enlarged detail view of the toe clip, taken generally on line 5—5 of FIG. 3, this view looking at the toe clip along the $x$—$x$ plane through the base portion.

FIG. 6 is a further enlarged fragmentary vertical sectional view thereof, showing the orientation of the base portion in the first portion prior to insertion into the sole-plate recess.

FIG. 7 is a view generally similar to FIG. 6, but showing the base portion in its second position as having been received in the recess cylindrical portion and rotated ninety degrees relative thereto to prevent unintended removal of the base portion from the recess.

FIG. 8 is a further enlarged vertical cross-sectional view of the base member leg portion.

DESCRIPTION OF THE PREFERRED EMBODIMENTS

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring initially to FIGS. 1 and 2, the present invention provides an improved toe clip, of which a preferred embodiment is generally indicated at 10, which is adapted to releasably retain the toe portion 11 of a ski boot, generally indicated at 12, to the front marginal end portion 13 of a sole-plate, generally indicated at 14.

Inasmuch as the ski boot 12 itself forms no part of the present invention except to the extent that the toe clip 10 may be employed to operatively mount such boot on the sole plate, the boot need not be explicitly described herein. Suffice it to say that boot 12 as shown as having a sole portion 15 which is adapted to contact the upper surface 16 of sole-plate 14, and an upper portion 18. Moreover, persons skilled in this art will recognize that such ski boots are commonly formed to have a horizontal arcuate toe notch 19 between the sole and upper portions at the forward end of the boot, which toe notch is adapted to receive a cable or some other member by which the toe portion 11 of the boot may be releasably secured to the sole-plate.

In the preferred embodiment herein illustrated and described, the sole-plate 14 is plastic and of the general type disclosed in U.S. Pat. No. 3,921,995, the aggregate disclosure of which is hereby incorporated by reference. However, the particular material of which sole-plate 14 is formed is not deemed to be critical to the present invention. Thus, while the sole-plate 14 is shown to be formed of a suitable high strength plastic, such sole-plate could also be formed of metal, as shown in the aforesaid U.S. Pat. No. 3,921,995, or any other suitable material. This sole-plate 14 has a substantially-planar horizontal upper surface 16 provided with a plurality of transversely-spaced longitudinally-extending flutes or grooves 20, and has a lower surface 21.

Referring now to FIGS. 1-3, 6 and 7, the front marginal end portion 13 of sole-plate 14 is shown provided with a plurality of recesses, generally indicated at 22, each of which extends into the sole-plate from one of the upper and lower surfaces 16, 21 thereof, and which extends continuously thereacross in a direction transverse to the longitudinal axis of the sole-plate from the vertical left side surface thereof (not shown) to the vertical right side surface 23 thereof (FIGS. 1 and 2). In the preferred embodiment, sole-plate 14 is shown provided with three of recesses 22, each of which extends upwardly into the sole-plate from the lower surface 21 thereof. However, it should be clearly understood that the sole-plate may be provided with any number of such recesses, and that such recesses may, alternatively, extend downwardly into the sole-plate from the upper surface 16 thereof.

Referring now particularly to FIGS. 6 and 7, each recess 22 of the preferred embodiment is depicted as having a key shape or outline, when viewed in longitudinal cross-section through the sole-plate. Thus, each of these key-shaped recesses 23 includes a cylindrically-segmented portion 24 having a relatively large diameter $D_R$, and a relatively narrow entrance portion 25 communicating the cylindrical portion 24 with the sole-plate lower surface 21. Specifically, the recess cylindrical portion 24 is bounded by sole-plate cylindrically-segmented wall surface 26, and the recess entrance porton 25 is bounded by sole-plate vertical left and right wall surfaces 28, 28, which are spaced apart by a relatively narrow distance $d_R$. As shown, the spacing $d_R$ between entrance portion walls 28, 28, is less than the diameter $D_R$ of cylindrical portion wall 26, for a purpose hereinafter explained.

Referring now to FIGS. 1-5, the inventive toe clip 10 is depicted as being a continuous or endless wire-like member configured to have a base portion 29 provided with two distal or marginal end portions 30, 30 (FIGS. 4 and 5); a leg portion 31 extending away from the base portion from each distal end thereof; and an arcuate loop portion 32 which is adapted to be received in the toe notch 19 of the ski boot (FIGS. 1 and 2). The arcuate shape of loop portion 32 urges the toe portion of a ski boot to a transversely centered position relative to the sole-plate.

Preferably, this toe clip is formed of a length of wire suitably bent to have the base, leg and loop portions previously described, with the marginal end portions 33, 33 of this wire being arranged in the base portion thereof and welded together, as indicated at 34, to provide a closed, continuous or endless member. This toe clip member may be conveniently formed of a suitable metal, such as A.I.S.I. C1018 steel, and may thereafter be case hardened and plated, if desired. Thus, this wire-like toe clip is relatively rigid.

Adverting now to FIGS. 6 and 8, this wire is shown as having a substantially-rectangular cross-section, and includes two opposite substantially parallel side surfaces 35, 35, and two opposite convex, and preferably cylindrically-segmented end surfaces 36, 36. Thus, this wire appears to have a substantially-rectangular outline having its overall height dimension $h$ greater than its overall width dimension $w$ (FIG. 8). Of course, the width $w$ of the wire is less than the spacing $d_R$ between the recess entrance portion walls 28, 28; and the height $h$ of the wire is greater than distance $d_R$, and slightly less than the nominal diameter $D_R$ of the recess cylindrical portion. Thus, the cross-sectional dimensional relationship of the member base portion 29 relative to the recess entrance and cylindrical portions allows the base portion to be oriented to a first position shown in FIG. 6 so that the base portion may pass through recess entrance portion to enter the cylindrical portion, after which the base portion may be rotated through an arc of approximately ninety degrees (FIG. 7) to a second position to prevent unintended separation of the base portion from the recess cylindrical portion. In one preferred embodiment, the recess dimension $D_R$ is 0.196 inches, the recess dimension $d_R$ is from 0.130 to 0.135 inches, the overall height ($h$) of the wire-like member is 0.187 ± 0.003 inches, and the overall width ($w$) of the wire-like member is 0.125 ± 0.003 inches, although these dimensions are exemplary of only one embodiment and are not limitative of the scope of the appended claims.

Another unique feature of the inventive toe clip 10 is that the base member may be formed to have a bow in each of two mutually perpendicular planes. In FIG. 8, a vertical plane $y$—$y$ and a horizontal plane $x$—$x$ are shown as intersecting at the midpoint 38 of the cross-section of the base portion 29. In the preferred embodiment, this base portion is formed to have a spring-like flexible bow from its longitudinal centerline in the $y$—$y$ plane (FIG. 5), and is also formed to have another spring-like flexible bow from its longitudinal centerline in the $x$—$x$ plane (FIG. 4). Desirably, these two bows are provided in the base portion along its entire length between its distal end portions 30, 30 so that the base member has a smooth continuous arcuate bow in each of these two planes along its entire length. Thus, the maximum extent of each bow will be arranged at the approximate middle of the base portion, and this is indicated as dimension X in for the bow in the $x$—$x$ plane (FIG. 4) and as dimension Y for the bow in the $y$—$y$ plane (FIG. 5). In the preferred embodiment, the length of the base portion is approximately 2.435 inches, and the X and Y dimensions are 0.015 - 0.020 and 0.025 - 0.030 inches, respectively, it being again understood that these dimensions are examplary only.

Thus, an operator must suitably manipulate or flex the base portion to reduce or remove the bow in the $x$—$x$ plane to permit the base portion to pass through the recess entrance portion. The effect of this is to prevent unintended removal of the base portion from the recess cylindrical portion without such flexure or manipulation. Once the base portion is arranged in the recess cylindrical portion, the bow in the $y$—$y$ direction will establish some frictional contact between the base portion and the cylindrical wall 26 defining recess cylindrical portion. The effect of this frictional engagement is to hold the toe clip in the operative position shown in FIGS. 1-3 unless acted upon by an external force. Of course, the operator may readily exert such external force to pivot the toe clip to any desired position.

As best shown in FIG. 3, the leg portions 31, 31 preferably extend away from the base portion along a plane inclined at an acute included angle of about ten degrees with respect to the $x$—$x$ plane.

If desired, the inventive toe clip 10 may further include at least one stop member 39 mounted on the base portion proximate an end thereof. The preferred embodiment is shown as including two of these stop members 39, each being in the form of a cylindrical washer-like member welded or otherwise secured to the base portion. These stop members are adapted to abut the left and right side surfaces of the sole-plate to resist lateral loads which might otherwise cause the toe clip to move transversely relative to the sole-plate. In lieu of welding the stop members 39, 39 to the base portion, a threaded connection (not shown) could be provided therebetween, and this feature would additionally permit the skier's boot to be canted laterally relative to the sole-plate.

Many changes and modifications may, of course, be made without varying the operative relationship between the recess and the toe clip. The particular dimensions of the preferred embodiment are exemplary only. Similarly, the wire-like toe clip may have other cross-sectional shapes and configurations, and may be formed by other techniques. Although A.I.S.I. C1018 steel is a preferred, other materials of construction may be used. Likewise, the subsequent case hardening and plating operations are optional.

Therefore, while a preferred embodiment of the present invention have been shown and described, persons skilled in this art will readily appreciate that other changes and modifications may be made without departing from the spirit of the invention, which is generically defined by the following claims.

What is claimed is:

1. In a ski binding for a ski boot having a toe notch, the improvement comprising:

a sole-plate having at least one recess extending thereacross, each recess having a substantially key-shaped cross-section including a cylindrical portion and a narrowed entrance portion communicating a surface of said sole-plate with said cylindrical portion; and a toe clip including a base portion having in transverse cross-section a width less than the width of said entrance portion, said base portion being arranged to pass through said entrance portion to be received in said cylindrical portion, including a leg portion extending away from said base portion from the marginal ends thereof, and including a loop portion joining said leg portions and arranged to be received in the toe notch of a ski boot;

whereby said toe clip may retain the toe portion of said ski boot to said sole-plate.

2. The improvement as set forth in claim 1 wherein said base portion is bowed in a first plane to provide a first spring which must be displaced to enable said base portion to pass through said entrance portion.

3. The improvement as set forth in claim 2 wherein arranged generally base portion is bowed in a second plane arranged perpendicular to said first plane to provide a second spring which is arranged to engage the wall surrounding said cylindrical portion to provide frictional resistance to rotation of said base portion relative to said sole-plate.

4. The improvement as set forth in claim 1 wherein said base portion, in transverse cross-section, has a height greater than the width of said entrance portion.

5. The improvement as set forth in claim 4 wherein said base portion has, in transverse cross-section, two opposite substantially parallel planar side surfaces along its height and two opposite convex end surfaces along its width.

6. The improvement as set forth in claim 1 and further comprising:

at least one stop member mounted on said base portion proximate an end thereof, said stop member being adapted to abut a side surface of said sole-plate to prevent further transverse movement of the base portion relative to the sole-plate.

7. The improvement as set forth in claim 1 wherein said toe clip is formed of a length of wire bent to have said base, leg and loop portions, and wherein the marginal end portions of said length of wire are welded together to provide a continuous member.

8. The improvement as set forth in claim 7 wherein said toe clip is case hardened.

9. The improvement as set forth in claim 5 wherein said leg portions extend away from said base portion in a direction perpendicular to said planar surfaces.

10. The improvement as set forth in claim 1 wherein said recess extends into said sole-plate from the lower surface thereof.

* * * * *